US005102385A

United States Patent [19]

Calvert

[11] Patent Number: 5,102,385

[45] Date of Patent: Apr. 7, 1992

[54] FEEDER MECHANISM FOR SLEEVE TYPE CARTONS

[75] Inventor: Rodney K. Calvert, Dunwoody, Ga.

[73] Assignee: The Mead Corporation, Dayton, Ohio

[21] Appl. No.: 664,639

[22] Filed: Mar. 5, 1991

[51] Int. Cl.[5] ..... B31B 5/80; B31B 1/80

[52] U.S. Cl. ..... 493/315; 493/316; 493/317

[58] Field of Search ..... 493/309, 313, 315, 316, 493/317

[56] References Cited

U.S. PATENT DOCUMENTS

| | | | |
|---|---|---|---|
| 2,887,022 | 5/1959 | Lubersky et al. | 493/315 |
| 3,599,541 | 8/1971 | Allen | 493/315 |
| 4,194,442 | 3/1980 | Martelli | 493/315 |
| 4,537,587 | 8/1985 | Langen | 493/315 |
| 4,596,545 | 6/1986 | Greenwell | 493/315 |

*Primary Examiner*—William E. Terrell
*Attorney, Agent, or Firm*—Rodgers & Rodgers

[57] ABSTRACT

A carton setup machine has a suction device for withdrawing collapsed sleeve type cartons from a magazine. The suction device moves inwardly and outwardly on a slidable rod as it orbits about a central rotating shaft. An oscillating gripper mounted outside the orbit of the suction device pulls outwardly on an outer panel of the collapsed carton to begin opening it.

11 Claims, 4 Drawing Sheets

FEEDER MECHANISM FOR SLEEVE TYPE CARTONS

TECHNICAL FIELD

This invention relates to packaging of primary articles such as cans or bottles in sleeve type cartons and is more particularly concerned with feeding such cartons in collapsed condition from a hopper and for initiating and then completing a set up operation of the cartons in sequence.

BACKGROUND ART

U.S. Pat. No. 3,575,409 issued April 20, 1971 and owned by the assignee of this invention concerns a carton feeder mechanism wherein motion of the cooperating parts is basically rotary in nature and without sharp and sudden changes in the direction of movement of the parts so as to accommodate high speed operation of the mechanism.

U.S. Pat. No. 3,991,660 issued Nov. 16, 1976 and owned by the assignee of this invention discloses and claims a carton expander mechanism for sequentially manipulating collapsed open ended sleeve type cartons out of a hopper and into set up open ended condition by a main feeder arm for sequentially engaging a lower carton wall to withdraw the associated carton from the hopper together with a supplementary feeder arm pivotally mounted on the main feeder arm and arranged with an end portion thereof adapted to project through an aperture in the lower carton wall so as to engage an upper carton face contacting wall thereby to move such wall away from the lower wall to facilitate setting up the collapsed carton.

U.S. Pat. No. 4,537,587 issued Aug. 27, 1985 discloses and claims a carton opening mechanism in which a first set of vacuum cups withdraws a collapsed carton from a hopper and swings such carton over into firm engagement with a second set of suction cups so as to condition the collapsed carton for a set up operation. In this patent, it would appear that transverse rotary movement of the first set of cups is tangential rather than radial relative to the carton to be picked up and that the cups would tend to slide along the wall of the carton in the hopper and thus might interfere with the appearance of the carton or with the efficiency of the set up operation. In this patent, the second cups do not move in a direction away from the first suction cups in order to set up the cartons.

U.S. Pat. No. 4,605,393 issued Aug. 12, 1986 discloses a carton blank removal erection and transfer apparatus in which a rotatable element is mounted on a shaft which in turn is mounted on an arm which is pivotally mounted at an end thereof remote from the shaft on which the rotatable pick up device is mounted. This arrangement apparently is objectionable because rotation of the suction cups tends to blemish the cartons and to effect an inefficient pick up operation due to sliding movement of the suction cups along the wall of the carton to be picked up.

U.S. patent application Ser. No. 434,190 filed Nov. 13, 1989 and owned by the assignee of this invention discloses a carton feeding machine in which carton pick up means is slidably mounted on a support rod secured at one end to a main drive shaft and arranged for its other end to protrude through an opening in one face contacting panel of a collapsed carton so as to engage and move the other face contacting panel in a direction away from the panel in which the opening is formed.

SUMMARY OF THE INVENTION

According to this invention in one form, collapsed sleeve type end loading cartons having face contacting panels are withdrawn in sequence from a hopper and set up thereof is initiated by a mechanism including a shaft which is rotatable about a fixed axis, carton pick up means for sequentially engaging one of the face contacting panels of each carton and for withdrawing the associated collapsed carton from the hopper, a rotatable elongated support rod having one end thereof slidably secured to the rotatable shaft for sliding reciprocal transverse movement relative to the rotatable shaft and on which the carton pick up means is fixedly mounted for orbital movement about the rotatable shaft, and oscillatable means disposed outside the path of orbital movement of the carton pick up means and engageable with the other face contacting panel so as to move the other face contacting panel in a direction away from the carton pick up means thereby to initiate a carton set up operation.

BEST MODE OF CARRYING OUT THE INVENTION

Figure 1:
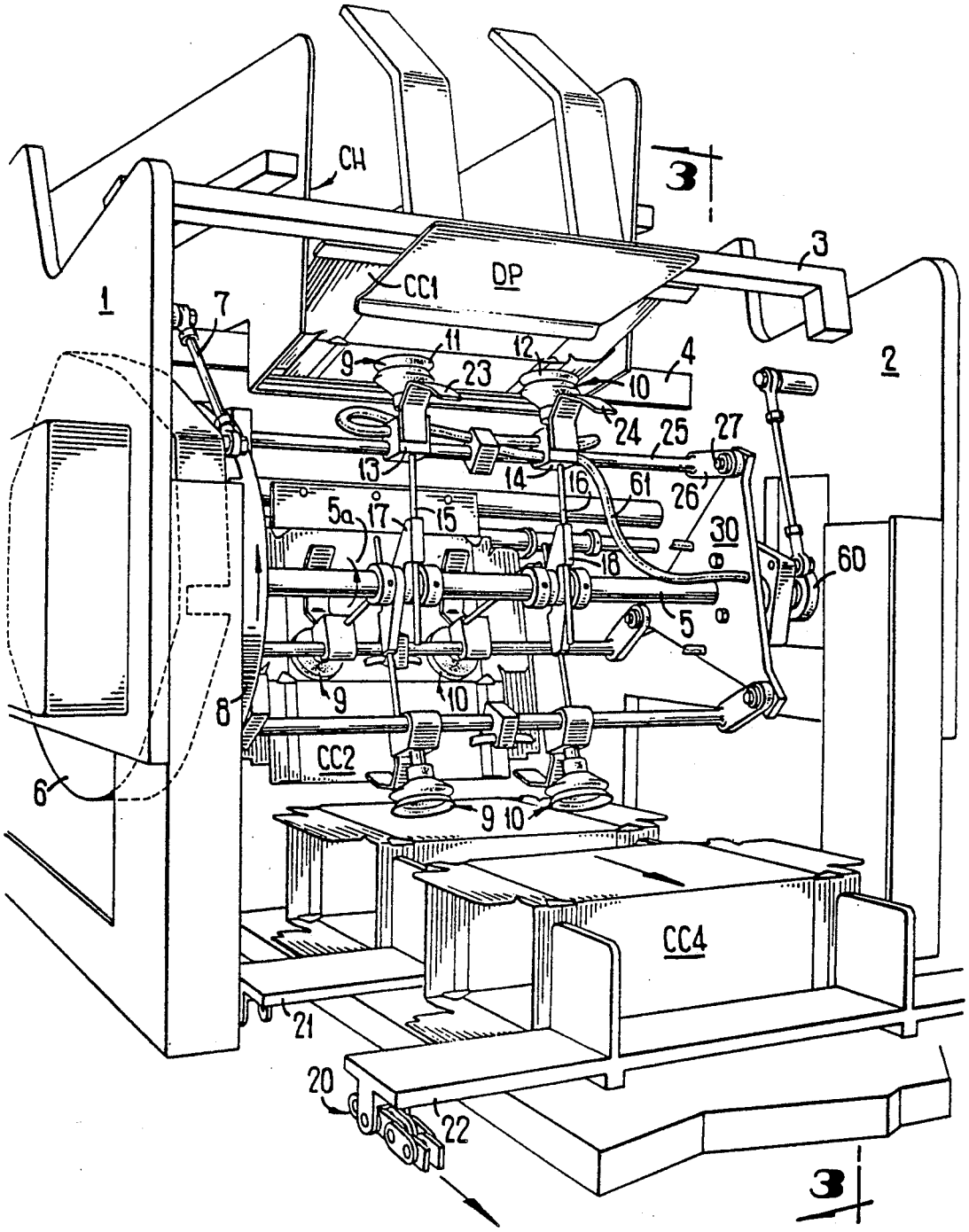
FIG. 1 is a perspective view of a packaging machine constructed according to this invention.

With reference to FIG. 1, parts of a pair of side frame supports 1 and 2 are shown interconnected along their upper edges by transverse connecting rods 3 and 4. Other transverse support rods such as 3 and 4 do not appear in FIG. 1.

A carton hopper generally designated at CH is supported by transverse support rods 3 and 4 and includes sleeve type open ended cartons which are designated at CC1.

The feeder mechanism formed according to this invention includes a main shaft 5 rotatable about a fixed axis and is journally supported at its ends in suitable bearing structure not shown but which is conventional and which is supported by side frame supports 1 and 2. Suitable conventional driving mechanism is arranged to rotate shaft 5 but is not shown in the drawings. A fixed cam plate 6 is mounted on the inner surface of side frame support 1 and is adjustably positioned on side frame support 1 by a turn buckle designated by the numeral 7. Fixed cam plate 6 is provided with an aperture not shown through which drive shaft 5 extends. A rotatable plate 8 is fixedly secured to drive shaft 5 and is rotatable therewith. Rotatable plate 8 is disposed in close proximity to fixed cam plate 6.

For withdrawing the lowermost collapsed carton from the hopper CH, a pair of pick up elements 9 and 10 include suction cups 11 and 12 which are supported by cup holders 13 and 14 respectively. Cup holders 13 and 14 are fixedly mounted respectively on elongated support rods 15 and 16 which are slidably mounted respectively in collar structures 17 and 18 which collar structures are rigidly secured to main rotatable shaft 5.

It is apparent from FIG. 1 that three sets of carton pick up devices such as 9 and 10 are provided in association with main rotatable shaft 5. Only one set of such devices such as those indicated at 9 and 10 are herein described in detail because all three sets of pick up devices are of the same construction and operate in an identical fashion.

As is apparent from FIG. 1, rotation of main shaft 5 is in the direction indicated by the arrow 5*a*. Also as is generally indicated in FIG. 1, a carton such as CC is withdrawn from hopper CH and is moved downwardly alongside deflector plate DP and onto the outfeed conveyor generally designated by the numeral 20 which includes flight bars such as 21 and 22. Only one of two conveying chains is shown in the drawings. When a carton such as CC4 is deposited atop conveying chain 20 between flight bars 21 and 22 suction pressure from the vacuum cups 11 and 12 is cut off. Deflector plate DP bends the carton slightly and aids in keeping the carton collapsed temporarily.

Figure 2:
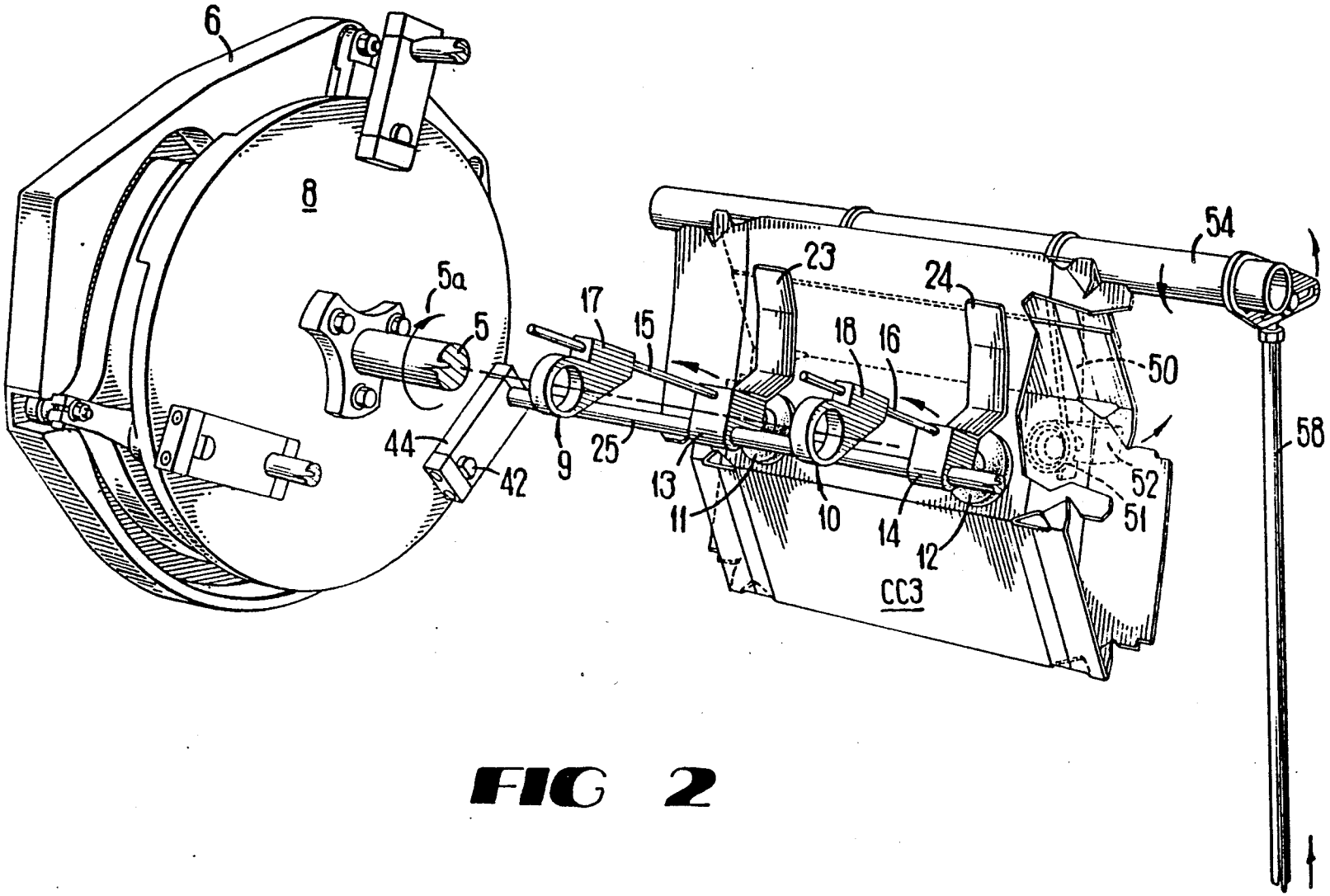
FIG. 2 is an enlarged perspective view of the main rotatable shaft and of a cam rod and associated elements shown holding a first carton panel and with parts of the carton broken away to show oscillatable means including suction cups arranged to engage and move another carton during a carton set up operation.
Figure 3:
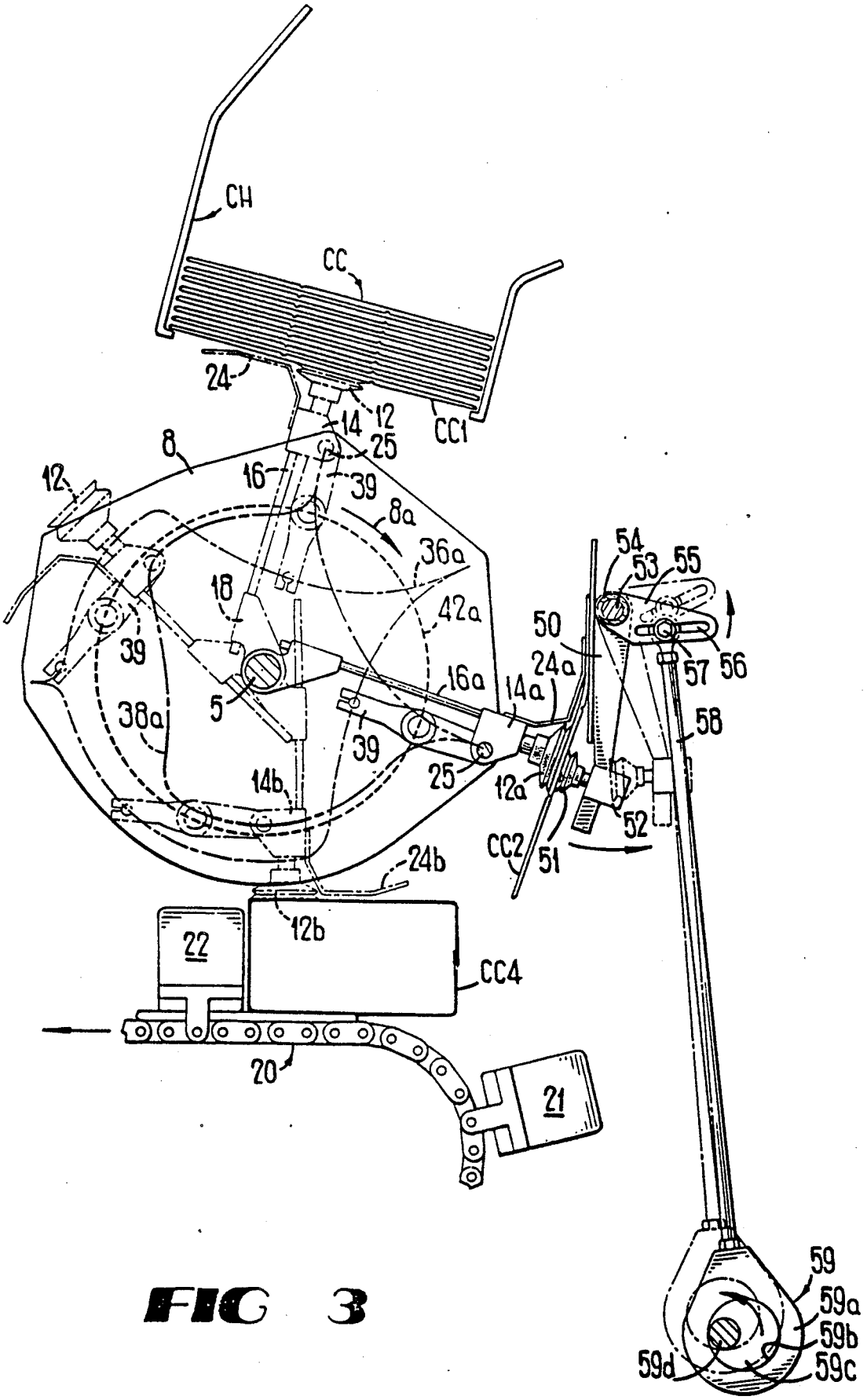
FIG. 3 is a cross sectional view of the machine taken along the line designated 3—3 in FIG. 1 but with parts removed for clarity.
Figure 4:
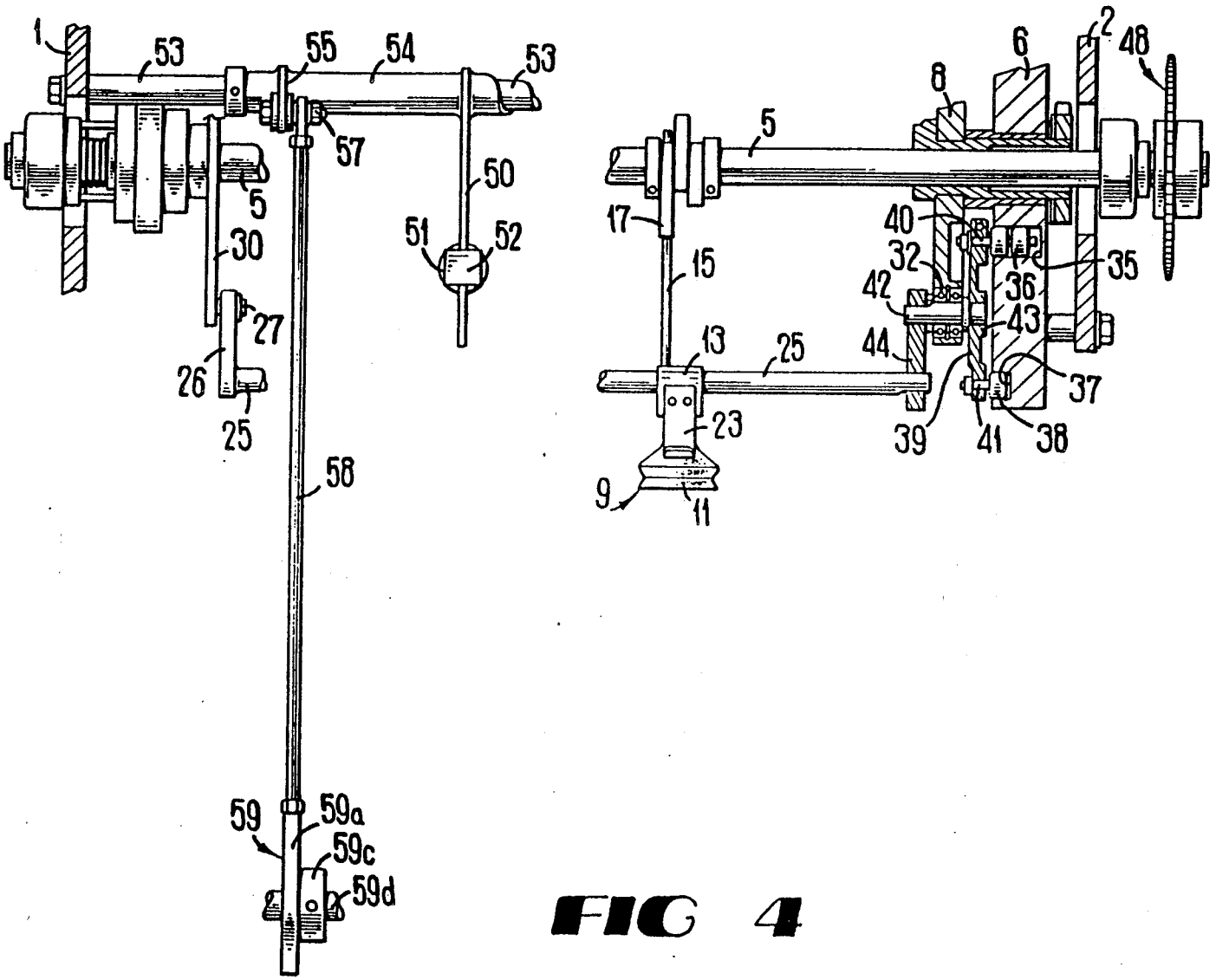
FIG. 4 is an enlarged view partially in section of carton pick up means and its cam operated control mechanism for engaging a first panel of a collapsed carton and also depicts oscillatable means which engages another carton panel so as to move such panel in a direction away from the first panel.

Appropriate manipulation of the carton pick up and set up devices is effected according to this invention by structure shown in FIGS. 2, 3 and 4. Associated with the cup holders 13 and 14 is the cam rod 25 which extends through apertures formed in cup holders 13 and 14 as is best shown in FIG. 2. Cup holders 13 and 14 are pivotally secured to cam rod 25 which at one end is rigidly secured to cam arm 26. Cam arm 26 is secured to cam shaft 27 which is rotatably mounted to rotatable plate 30 as shown in FIG. 4.

With reference to FIG. 4, a deep cam track 35 is formed in fixed cam plate 6 and dual cam rollers 36 are disposed within deep cam track 35. Shallow cam track 37 is provided and single cam roller 38 is disposed within shallow cam track 37. Cam bar 39 is connected with dual cam rollers 36 by a stem shaft 40 and single cam roller 38 is connected with cam bar 39 via stem shaft 41. Cam shaft 42 is rigidly secured at its right hand end to hub portion 43 of cam bar 39 and is rotatable in bearings 32 mounted in rotatable plate 8. Cam arm 44 is rigidly secured to the left hand end of cam shaft 42 and at its other end to the adjacent end of cam rod 25.

For the purpose of imparting rotation to main shaft 5, motive means generally designated at 48 is provided. Such means is conventional and could include a sprocket and chain drive together with suitable bearing structure.

As is apparent, the path of travel of cam shaft 42 is a circle and this path on FIG. 3 is indicated at 42*a*. Also as is apparent from FIGS. 3 and 4 the path of movement of dual rollers 36 in deep cam track 35 is represented in FIG. 3 at 36*a* while single cam roller 38 is disposed in the shallow cam track 37 whose path of travel is indicated in FIG. 3 by the numeral 38*a*.

The travel path 42*a* of cover shaft 42, 36*a* of dual roller 36 and 38*a* of single roller 38 are divergent as is apparent from FIG. 3. This function is more fully explained in U.S. Pat. No. 4,625,575 issued Dec. 2, 1986 and owned by the assignee of this invention.

FIGS. 2, 3 and 4 show the relative positions of suction cup 12, its cup holder 14 and its associated support rod 16 only. The other two pick up structures which are observable in FIG. 1 but not described in detail are omitted in FIGS. 2, 3 and 4 for clarity.

As rotatable cam plate 8 rotates in a clockwise direction as viewed in FIG. 3 and as indicated by the arrow 8*a*, the cup 12, the cup holder 14 and the support rod 16 move in a clockwise direction from their positions immediately below the carton hopper CH to the positions shown in solid lines and indicated at 12*a*, 14*a* and 16*a* which are adjacent the position of a pivotally mounted oscillatable crank arm 50 shown in solid lines in FIG. 3.

It is at this position of the parts that the structure which constitutes a principal aspect of this invention is shown. Suction cup 51 is shown in contact with a wall of carton CC2 which is in face contacting relation with the carton wall which is engaged by suction cup 12 in FIG. 3. This suction cup 51 is mounted on a cup holder 52 secured to the crank arm 50 which in turn is pivoted about the fixed shaft 53 mounted at its ends on side plates 1 and 2. A sleeve 54 best shown in FIG. 4 is rotatable about the fixed shaft 53 and the crank arm 50 is rigidly secured to sleeve 54. A link 55 is rigidly secured by welding or otherwise to the sleeve 54 and includes a slot 56 best shown in FIG. 3 in which a bolt 57 is slidably adjustable. Bolt 57 is interconnected with a vertically reciprocable rod 58 which at its lower end is connected with an oscillatable motive mechanism 59. The housing structure 59*a* includes a cylindrical opening 59*b* in which an eccentrically mounted cylinder 59*c* is mounted integrally with a pin 59*d* journalled in suitable bearings on opposite surfaces of the housing 59 so that rotation of shaft 59*d* imparts vertical reciprocal motion to the rod 58. Such motion when upward swings the crank 50 counterclockwise about the pivot shaft 53 and with the parts in their dotted line positions. When shaft 58 moves downwardly, the parts move to the positions indicated in solid lines at which time the suction cup 51 engages the adjacent face contacting panel of carton CC2 so that motion thereafter in a counterclockwise direction of crank 50 draws the associated wall of the carton away from its face contacting panel and results in a partially set up condition of the carton which is now designated at CC3. In FIG. 2, a wall of the carton CC3 is broken away at the right hand end thereof and the suction cup 51, the cup holder 52 and the crank 50 are shown in dotted lines. As is obvious in FIG. 2 the carton CC3 is partially set up.

As clockwise rotation of rotatable plate 8 continues as viewed in FIG. 3, the suction cup 12 comes to a position indicated at 12*b*. The suction pressure must be cut off to release the carton and in order to enable the mechanism to deposit the carton now designated CC4 atop the outfeed conveying chain 20. High speed movement of the suction cup from its position indicated at 12*b* in a clockwise direction together with the movement of conveying chain 20 toward the left may tend to allow the carton CC4 on conveying chain 20 to ride upwardly in a direction away from the outfeed conveyor. In order to prevent such undesired movement of the carton, the leaf spring clip 24*b* is conveniently positioned so as to overlie the carton CC4 at a point immediately behind the suction cup at position 12*b* and thus effectively to secure the now set up carton in a position for movement into a position where primary packages may be loaded through the open ends of the carton.

Suction of air to the suction cups is controlled by a valve 60 mounted on one end of main shaft 5 as shown in FIG. 1. Valve 60 comprises side by side components one of which controls suction of cups such as 11 and 12 and the other of which controls the suction of cup 51. The line 61 controls cups such as 11 and 12 from one component of valve 60 and another line (not shown) from the other component of valve 60 controls cup 51.

According to this invention, the speed of operation of the apparatus is improved as well as its efficiency and durability. As can be seen from FIG. 3, the carton CC2 is moved from a collapsed position where the suction cup 12*a* is disposed to a fully set up condition CC4 when the suction cup is at position 12*b*. Of course the final set up operation is due in part to engagement with a corner of the carton with the flight bar 22 which then effects complete and final set up while the carton is still being held by the suction cup 12*b*.

I claim:

1. A machine for sequentially manipulating out of a hopper collapsed sleeve type end loading cartons having oppositely disposed face contacting panels and for initiating set up thereof into open ended condition, said machine comprising a shaft which rotates about a fixed axis, carton pick up means for sequentially engaging one of said face contacting panels and for withdrawing from the hopper the collapsed carton which includes said one of said face contacting panels, a rotatable elongated support rod having one end thereof slidably secured on a collar structure mounted on said shaft and on the other end of which said carton pick up means is fixedly mounted, said rod and pickup means slidingly reciprocating transversely relative to said rotatable shaft and moving orbitally about said rotatable shaft, oscillatable means disposed outside the path of orbital movement of said carton pick up means for engaging the other of said face contacting panels so as to pull said other face contacting panel in a direction away from said carton pick up means thereby to initiate opening the carton.

2. A machine according to claim 1 wherein said oscillatable means for engaging the other of said face contacting panels comprises suction cup means.

3. A machine according to claim 2 wherein said suction cup means is mounted on a pivotally mounted oscillatable crank arm movable in synchronism with said shaft.

4. A machine according to claim 3 wherein said pivotally mounted oscillatable crank arm is oscillated by eccentric driving means interconnected with said oscillatable crank arm by a driving link.

5. A machine according to claim 1 wherein said means for engaging the other of said face contacting panels cooperates with the outer surface of said other face contacting panel.

6. A machine according to claim 1 wherein orbital movement of said carton pick up means immediately prior to and during withdrawal of a carton from the hopper is arrested for a brief interval by the action of a cam controlled cam bar which is movable radially but not orbitally during such brief interval and which is operably connected with said carton pick up means.

7. A machine according to claim 6 wherein reciprocal radial movement of said oscillatable means is effected during a brief interval of arrested orbital movement of said carton pick up means by the action of said cam controlled bar following withdrawal of a carton from the hopper.

8. A machine according to claim 1 wherein said carton pick up means comprises suction cup means controlled by one component of valve means having side by side components driven by a common shaft.

9. A machine according to claim 8 wherein said oscillatable means for engaging the other of said face contacting panels is controlled by the other component of said valve means.

10. A machine according to claim 1 wherein said face contacting panels comprise opposite side walls of the cartons.

11. A machine according to claim 1 wherein each of said carton pick up means comprises a cup holder and a suction cup mounted on said cup holder and arranged to deposit a set up carton on a conveying chain and wherein a leaf spring clip is mounted on each of said cup holders and disposed to engage and hold a carton down following deposit thereof on said conveying chain.

* * * * *